United States Patent [19]

Moineau

[11] Patent Number: 4,867,189

[45] Date of Patent: Sep. 19, 1989

[54] WATER FLOW SHOWER CONTROL VALVE AND METHOD

[75] Inventor: Hubert J. Moineau, Bolton, Mass.

[73] Assignee: Automatic Specialties, Inc., Marlboro, Mass.

[21] Appl. No.: 207,738

[22] Filed: Jun. 16, 1988

[51] Int. Cl.[4] ..... B05B 1/30

[52] U.S. Cl. ..... 137/1; 251/30.01; 239/70; 137/624.12

[58] Field of Search ..... 137/624.11, 624.12, 137/624.22, 1; 251/30.01, 31; 239/70

[56] References Cited

U.S. PATENT DOCUMENTS 4,230,155 10/1980 Frye ..... 137/624.22

4,345,621 8/1982 Dunckhorst ..... 137/624.12

*Primary Examiner*—Alan Cohan

*Attorney, Agent, or Firm*—Richard P. Crowley

[57] ABSTRACT

The length of time a bather can use a shower is controlled by a pair of timers and a solenoid operated valve. A first timer controls the length of time water flows through the shower by energizing and de-energizing solenoids. Another timer prevents the solenoids from being energized for a predetermined time period after the first timer has turned the water off. This prevents the shower from being turned on again until the time period has elapsed.

20 Claims, 3 Drawing Sheets

WATER FLOW SHOWER CONTROL VALVE AND METHOD

BACKGROUND OF THE INVENTION

This invention relates to the control of water flow, and more particularly to controlling the time during which water can be used for bathing. Running water through a shower for an excessive time wastes both water and the fuel needed to heat the water. This can occur when someone spends too much time bathing, or when a shower is left running after the bather has departed. Prior attempts to control the time spent bathing with timers have been deficient in that they could be defeated simply by re-starting a timer as soon as it had shut off the water.

OBJECTIVES OF THE INVENTION

Accordingly, it is an object of this invention to provide improved means and methods for controlling the flow of water.

Another object is to provide efficient solenoid activated valves.

Another object is to provide a system that conserves water and the energy needed to heat the water.

Another object is to control the time period during which a valve permits water for bathing to pass through a shower head.

Another object is to provide a flow control system that shuts off water flow after a predetermined time period and does not allow the water flow to be resumed until after another time period has elapsed.

Another object is to turn off a shower after it has been used for long enough to clean the bather, and thus to prevent the bather from turning the shower on again for a long enough time to discourage an attempt for a second or a longer shower.

Another object is to turn off the flow of bathing water after a first period of time and to keep the water turned off for a second period of time, with neither period of time being controllable by bathers.

Another object is to provide a battery operated liquid flow control valve that employs a pair of solenoids.

Another object is to provide an efficient hot water control system.

Another object is to provide a low voltage shower control system that uses a timer to prevent frustration of the objectives of the control system, that is durable, relatively economical, easy to repair and maintain, and which does not possess defects found in similar prior art systems.

Other objects and advantages of the invention will be revealed in the specifications and claims, and the scope of the invention will be set forth in the claims.

DESCRIPTION OF THE INVENTION

Figure 1:
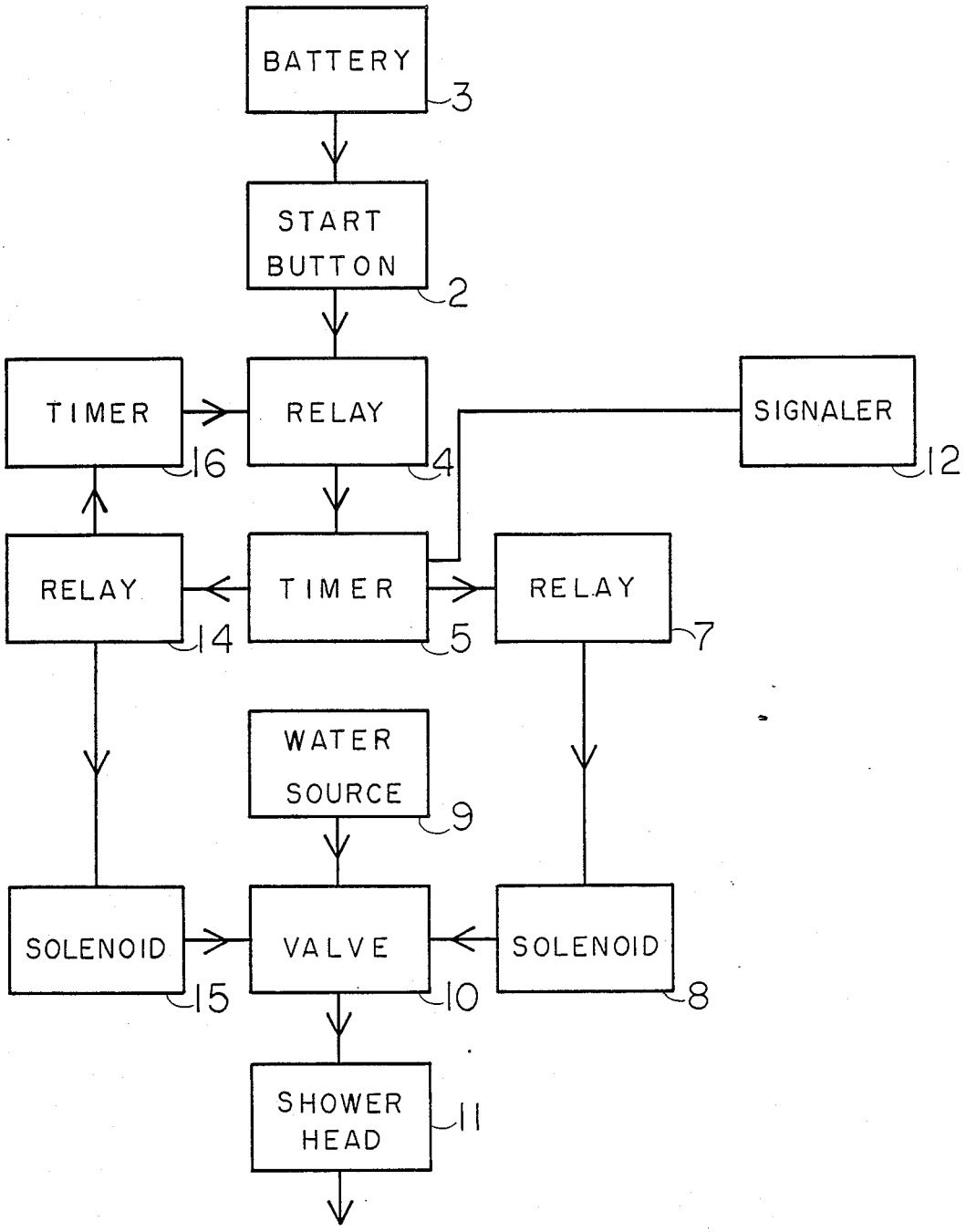
FIG. 1 is a schematic representation of a water flow control system in accord with this invention.

The drawing shows a water flow control system 1 that limits the use of a shower to a predetermined first period of time, after which the shower is automatically turned off, and that prevents the shower from being turned on again until after a second predetermined period of time has elapsed. A person taking a shower activates the system and starts the shower by pushing a button 2 that is located conveniently to the shower. This connects low voltage dry cell battery means 3 to normally closed first relay means 4 and activates first timer means 5 which closes and then opens normally open second relay means 7. The closing and opening of relay means 7 energizes and then de-energizes first solenoid 8, which permits water to flow from a pressurized source 9 of heated water through flow control valve means 10 in a manner described hereafter; the water then flows through shower head 11 to the person taking a bath. After a predetermined first time period, timer means 5 activates signal producing means 12; this sounds a buzzer or a bell and alerts the person taking a shower that the water will be turned off in a short time (e.g. one minute). After such short time has elapsed, timer means 5 closes and then opens normally open third relay means 14 and starts second timer means 16. The closing and opening of relay means 14 energizes and then de-energizes second solenoid 15, which stops water from flowing from source 9 through control valve means 10, in a manner described hereafter. As flow is stopped through valve means 10, second timer means 16 opens normally closed relay means 4 and keeps relay means 4 open for a predetermined second time period. With relay means 4 open, first timer means 5 and relay means 7 are disconnected from battery means 3, so the shower can not be turned on again by pushing button 2. After the second time period has passed, timer means 16 lets relay means 4 close again, which permits the shower to be turned on again by a bather pushing button 2. Except for valve means 10 as described below, all components of system 1 are conventional, so they have not been described in detail.

One embodiment of a solenoid activated valve 19 usable as the valve means 10 in flow control system 1 is shown in FIGS. 2–5. Valve 19 has a body 20 with an inlet 21 connected to pressurized water source 9 and an outlet 22 connected to shower head 11. Inlet 21 and outlet 22 are essentially the same size and are aligned along a transverse axis of body 20 through the center of the body. A flow control chamber 23 connects the inlet and outlet, and a flow control piston 24 having a first end 25 and s second opposite end 26 is slidable in chamber 23. Piston 24 has an off-center conduit 27 for selectively connecting inlet 21 to outlet 22 and for blocking flow between the inlet and outlet. A first passage 29 connects inlet 21 to first end 25 of the piston and a second passage 30 connects inlet 21 to second end 26 of the piston. Flow through first passage 29 is controlled by a first ball check valve 31 which seats against a first O-ring 32, and flow through second passage 30 is controlled by a second ball check valve 33 which seats against a second O-ring 34. Passages 30 and 31 continue past their respective ball valves to outlet 22 via segments 29' and 30'. In system 1 first solenoid 8 would be attached to one end of valve body 20 and second solenoid 15 would be attached to the opposite end. Solenoids 8 and 15 respectively would have coaxial actuator rods 36 and 37 that project toward each other along the central axis of body 20.

Figure 2:
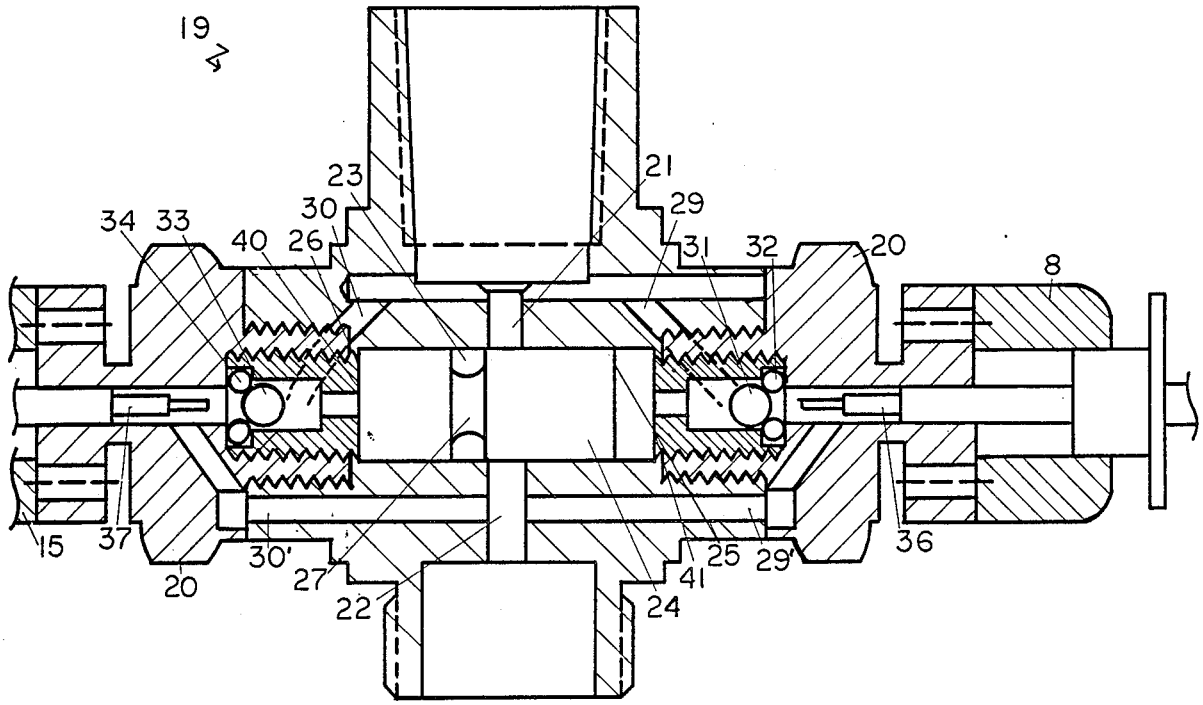
FIG. 2 is a cross sectional view of a valve in accord with this invention showing the valve closed.

When valve 19 is used, system 1 operates as follows. FIG. 2 shows the off position of valve 19 with no water flowing from inlet 21 to outlet 22. Flow can not occur because the pressure through passages 29 and 30 on opposite ends 25 and 26 of piston 24 is equal, both ball check valves 31 and 33 are seated against their respective O-ring seals, and second end of piston 24 rests against a shoulder 40 that defines one end of chamber 23, and this causes conduit 27 through piston 24 to be out of alignment with inlet 21 and outlet 22.

Figure 3:
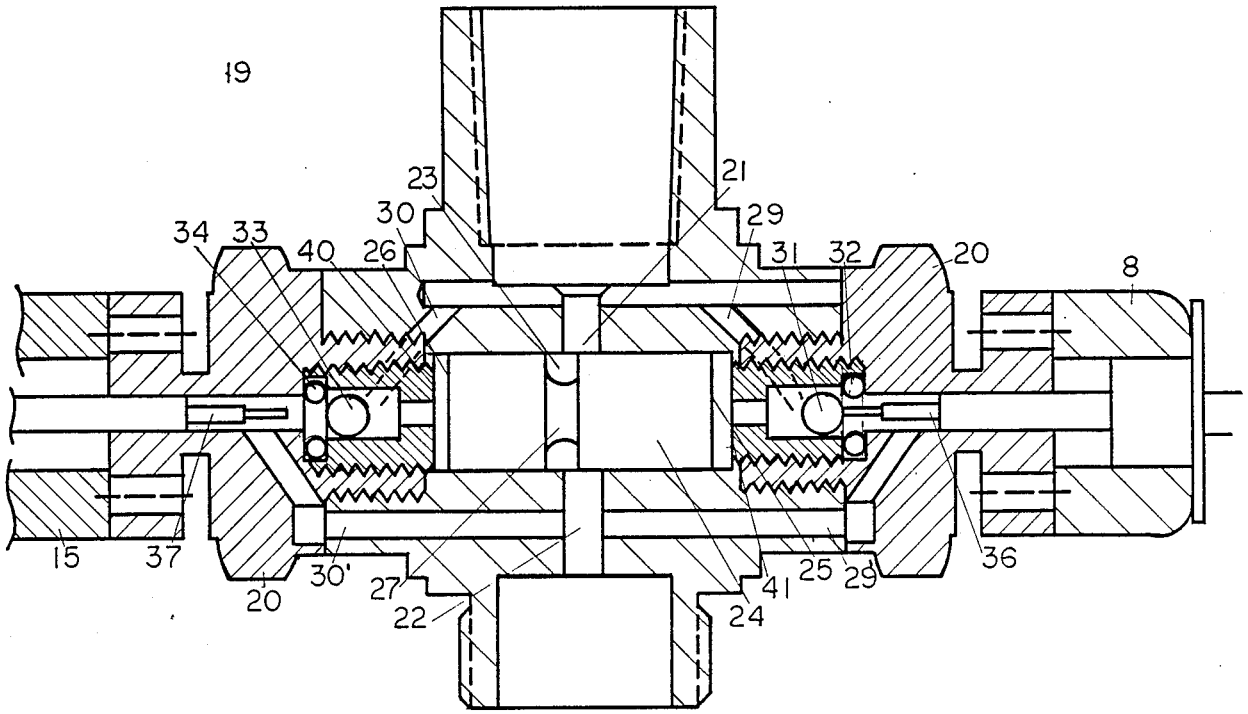
FIG. 3 is a cross sectional view of the embodiment of FIG. 2 showing the valve partially opened.
Figure 4:
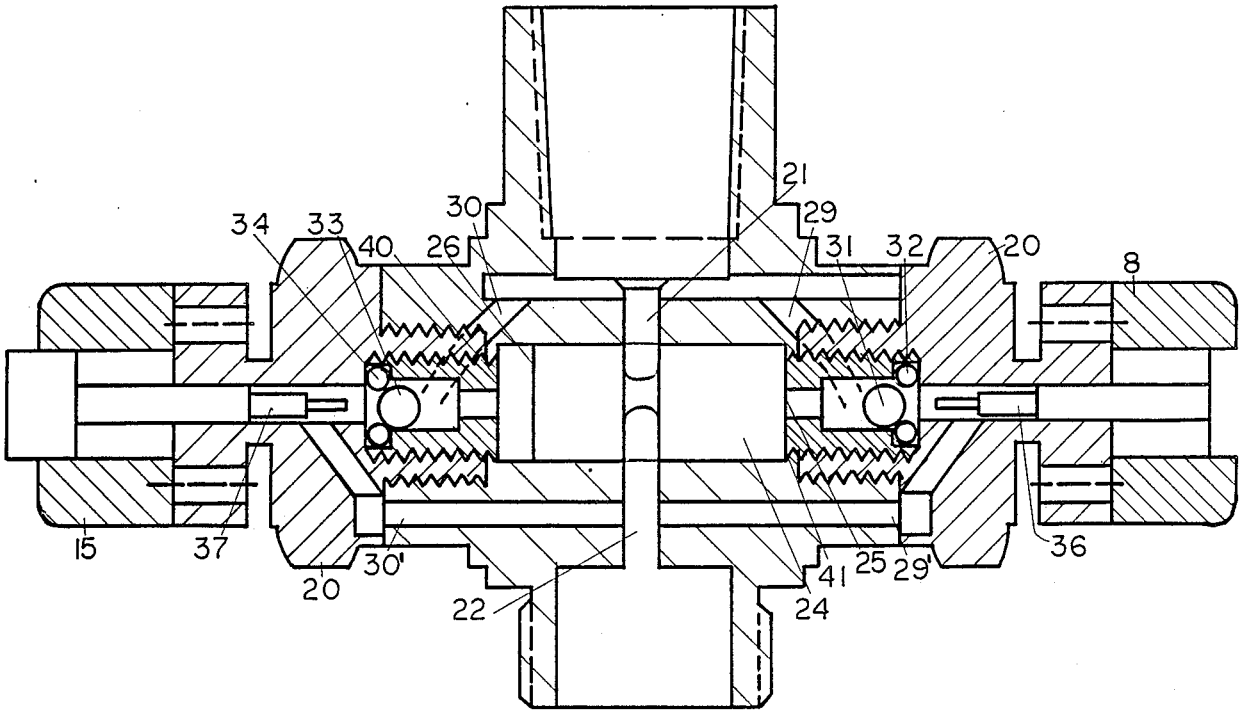
FIG. 4 is a cross sectional view of the embodiment of FIG. 2 showing the valve fully opened.
Figure 5:
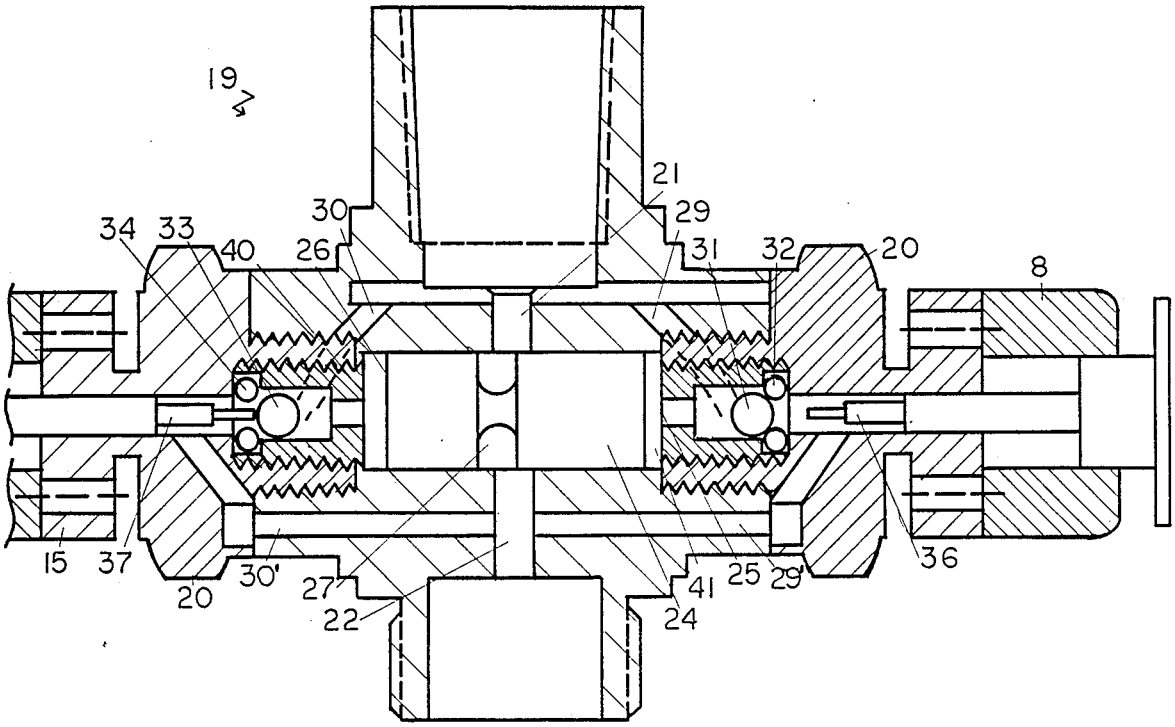
FIG. 5 is a cross sectional view of the embodiment of FIG. 2 showing the valve partially closed.

To begin a shower, the bather pushes button 2 which connects timer 5 to battery 3 through relay 4. Timer 5 closes relay 7 and this lets current flow from battery 3 to solenoid 8. Momentary energization of solenoid 8 causes its rod 36 to move along the central axis of valve body 20 until rod 36 contacts ball valve 31 and moves the ball off O-ring seal 32. The unseating of valve 31 opens first passage 29 and connects inlet 21 to outlet 22 through passage 29 and 29'. Since outlet 22 is essentially at the pressure of shower head 11, the pressure on the first end 25 of piston 24 is reduced and the piston moves out of contact with shoulder 40 toward a shoulder 41 at the other end of chamber 23. This moves conduit 27 into partial alignment with inlet 21 and outlet 22, as shown in FIG. 3. Piston 24 moves into contact with shoulder 41 and timer 5 opens relay 7, which turns off solenoid 8 causing the water pressure in passage 29 to force ball check valve 31 to seal against O-ring 32 and rod 36 to retract back through O-ring 32. As shown in FIG. 4 water is now flowing from inlet 21 through conduit 27 to outlet 22, and from there through shower head 11 to the bather for the duration of the first predetermined time period. With both check valves 31 and 33 seated, the pressure is equal on the opposite ends 25 and 26 of piston 24. A short time before the first timer period ends, timer 5 activates signaling means 12 to provide an audible warning to the bather and soon thereafter timer 5 closes relay 14. This lets current to flow from battery 3 to solenoid 15. Energization of solenoid 15 causes its rod 37 to move along the central axis of valve body 20 until rod 37 contacts ball valve 33 and moves the valve off O-ring seal 34. The unseating of valve 33 opens second passage 30 and connects inlet 21 to outlet 22 through passage 30 and 30'. This reduces the pressure on the second end 26 of piston 24 and causes the piston to move toward shoulder 40 as shown in FIG. 5. After piston 24 has moved into contact with shoulder 40, timer 5 opens relay 14 which turns off solenoid 15 causing the water pressure in passage 30 to force ball check valve 33 to seal against O-ring 34 and rod 37 to retract back out of O-ring 34. The parts of valve 19 now have the positions shown in FIG. 2 and the shower has been turned off. Timer 5 activates timer 16 which opens relay 4 and prevents the energization of solenoid 8 for a second period of time, as explained above, so that the shower can not be turned on again until the second period has expired.

The invention also includes methods for automatically controlling water flow through shower head 11. The water flowing to the shower head is confined in that all of the water must pass through valve means 10, which opens to permit water flow and closes to prevent water flow. Controlling the time during which a bather can shower is accomplished by timing of the flow of water through shower head 11 with timer means 5 and automatically closing valve means 10 after a predetermined first time period has elapsed. Timer means 16 is used for automatically preventing resumption of water flow by deactivating valve means 10 in its closed position until after a predetermined second time period has elapsed.

It has thus been shown that by the practice of this invention, water flow control system 1 places the time that a shower can be used out of the control of a bather. This conserves water and the energy needed to heat it. The system can not be defeated because second timer 16 prevents restarting the shower until after a predetermined time has elapsed. The control components may be locked up or placed out of the reach of bathers, so a bather can not change the first and second time periods. The use of a pair of solenoids aligned along the central axes of valve 19 and valve 42 simplifies the operation of the valves and reduces the current drain on battery means 3.

While the invention has been described with reference to particular embodiments, it is not intended to illustrate or describe herein all of the equivalent forms or ramifications thereof. Also, the words used are words of description rather than limitation, and various changes may be made without departing from the spirit or scope of the invention disclosed herein. For example, signaller 12 may provide a visual signal instead of or in addition to an audible signal. It is intended that the appended claims cover all such changes as fall within the true spirit and scope of the the invention.

What is claimed is:

1. Means for controlling the flow of water, comprising:

A. valve means that opens to permit water to flow and closes to prevent the flow of water:

B. first timer means for opening said valve means and controlling a first time period during which said valve means remains opened; and after said first time period expires, said first timer means preventing the flow of water by closing said valve means; and C. second timer means for preventing resumption of water flow for a second time period by deactivating said first timer means during said second time period so as to prevent said first timer means from opening said valve means during said second time period.

2. The invention defined in claim 1, wherein said first timer means activates signal producing means a predetermined time before closing of said valve means.

3. The invention defined in claim 1, wherein said first timer controls the flow of water through said valve means by activating solenoid means.

4. The invention defined in claim 3, wherein activation of first solenoid means opens said valve means and activation of second solenoid means closes said valve means.

5. The invention defined in claim 4, wherein said first and second solenoid means are aligned so as to act along a common axis.

6. The invention defined in claim 4, wherein said first and second solenoid means are activated by the closing of normally open relay means by said first timer means.

7. The invention defined in claim 1, wherein said first timer means is connected to a source of power through normally closed relay means, and said second timer means prevents the opening of said valve means during said second time period by opening said normally closed relay means during said second time period.

8. The invention defined in claim 1, wherein said valve means comprises:

A. a water inlet, a water outlet, and a flow control chamber connecting said inlet and outlet;

B. a water flow control piston slidable in said control chamber and having first and second ends;

C. a first passage communicating with said inlet and with said first end of said piston, a first check valve in said first passage for preventing water from flowing out of said passage, and a second passage communicating with said inlet and with said second end of said piston, a second check valve in said second passage for preventing water from flowing out of said second passage; and D. a first solenoid for opening said first check valve and causing water to flow from said inlet to said outlet, and a second solenoid for opening said second check valve and preventing water flow from said inlet to said outlet.

9. The invention defined in claim 8, wherein said first and second passages each connect said inlet to said outlet, and said first and second check valves each prevent water from flowing from said inlet to said outlet.

10. The invention defined in claim 8, wherein said check valves are ball valves.

11. The invention defined in claim 10, wherein said solenoids each have a rod projecting therefrom and energization of said solenoids causes said rods to move into contact with said ball valves so as to unseat said ball valves.

12. The invention defined in claim 11, wherein said rods are coaxial.

13. The invention defined in claim 8, wherein said piston has a conduit for connecting said inlet to said outlet.

14. The invention defined in claim 8, wherein said first and second passages each connect said inlet to separate first and second drainholes.

15. Electrically operated means for controlling the flow of water to a shower head comprising:

A. a valve comprising:

1. a water inlet connected to a source of shower water, a water outlet connected to a shower head and a flow control chamber connecting said inlet and outlet;

2. a water flow control piston slidable in said control chamber and having first and second opposite ends, said piston having a conduit for connecting said inlet to said outlet;

3. a first passage communicating with said inlet and with said first end of said piston, a first ball check valve in said first passage for preventing water from flowing out of said passage, and a second passage communicating with said inlet and with said second end of said piston, a second ball check valve in said second passage for preventing water from flowing out of said second passage; and 4. a first solenoid having a rod projecting therefrom for unseating said first ball check valve and causing water to flow from said inlet to said outlet when said first solenoid is energized, a second solenoid having a rod projecting therefrom for unseating said second ball check valve and preventing water flow from said inlet to said outlet, and said rods projecting coaxially toward each other along the central axis of said valve from said first and second solenoids;

B. a low voltage dry cell battery;

C. first timer means for opening said valve by energizing said first solenoid and controlling a first time period during which said valve remains opened and water flows to said shower head; after said first time period expires, said first timer means preventing the flow of water to said shower head by energizing said second solenoid and closing said valve; said first timer means activating signal producing means a predetermined time before closing of said valve means to warn that said shower will soon be shut off; and said first timer means being connected to said battery through normally closed relay means; and D. second timer means activated by said first timer means for preventing resumption of water flow to said shower head for a second time period by opening said normally closed relay means during said second time period so as to prevent said first timer means from energizing said first solenoid during said second time period.

16. The invention defined in claim 15, wherein said conduit is off center in said piston, said first and second passages each connect said inlet to said outlet, and said first and second ball check valves each prevent water from flowing from said inlet to said outlet.

17. A method for controlling the flow of water, which method comprises:

(a) providing a water control valve that opens to permit the flow of water and closes to prevent the flow of water;

(b) activating by a first electrically powered solenoid a first timer to open the water control valve for a first time period;

(c) activating by a second electrically powered solenoid said first timer to close the water control valve after said first time period expires; and (d) preventing the opening of the water control valve for a second time period by a second timer by deactivating the first timer so as to prevent the opening of the water control valve during the second time period.

18. The method of claim 17 which includes activating a signal producing means a predetermined time before the activating of the second solenoid to alert a water user that the water flow will stop shortly.

19. The method of claim 17 which includes activating the first and second solenoid along a common axis.

20. The method of claim 17 which includes controlling the flow of water through a shower head.

* * * * *